US008937633B2

(12) United States Patent
Kikkawa

(10) Patent No.: US 8,937,633 B2
(45) Date of Patent: Jan. 20, 2015

(54) LIGHTING APPARATUS, CONTROL METHOD THEREFOR AND BACKLIGHT APPARATUS

(71) Applicant: Canon Kabushiki Kaisha, Tokyo (JP)

(72) Inventor: Teruki Kikkawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 122 days.

(21) Appl. No.: 13/800,298

(22) Filed: Mar. 13, 2013

(65) Prior Publication Data

US 2013/0265336 A1 Oct. 10, 2013

(30) Foreign Application Priority Data

Apr. 10, 2012 (JP) ..... 2012-089619

(51) Int. Cl.
*G09G 5/10* (2006.01)
*G09G 3/00* (2006.01)
*G09G 3/34* (2006.01)

(52) U.S. Cl.
CPC ..... *G09G 3/001* (2013.01); *G09G 3/3426* (2013.01); *G09G 2310/0237* (2013.01); *G09G 2310/024* (2013.01); *G09G 2320/0247* (2013.01); *G09G 2320/064* (2013.01); *G09G 2360/145* (2013.01)
USPC ..... 345/690; 345/691; 345/699; 345/102

(58) Field of Classification Search
None
See application file for complete search history.

(56) References Cited

U.S. PATENT DOCUMENTS 6,495,964 B1 12/2002 Muthu et al.
6,977,642 B2 * 12/2005 Nagatani ..... 345/102

FOREIGN PATENT DOCUMENTS

JP 4094952 6/2008

* cited by examiner

*Primary Examiner* — Muhammad N Edun
(74) *Attorney, Agent, or Firm* — Cowan, Liebowitz & Latman, P.C.

(57) ABSTRACT

A lighting apparatus includes a plurality of light sources of which emissions of light are able to be controlled independently of one another, a control unit configured to control brightness of each light source, and a measurement unit configured to measure the brightness of each light source. In cases where the brightness of each light source is measured, the control unit carries out a first control which causes a measurement target light source to turn on and at the same time light sources other than the measurement target light source to turn off, and a second control which decreases the brightness of each of the light sources in a stepwise manner immediately before a turn-off period of time thereof, and which increases the brightness of each of the light sources in a stepwise manner immediately after the turn-off period of time.

10 Claims, 15 Drawing Sheets

TURN-ON BLOCK
TURN-OFF BLOCK

LIGHTING APPARATUS, CONTROL METHOD THEREFOR AND BACKLIGHT APPARATUS

BACKGROUND OF THE INVENTION

1. Field of the Invention

The present invention relates to a lighting apparatus, a control method therefor and a backlight apparatus.

2. Description of the Related Art

A liquid crystal display device is a display device making use of optical transparency of a liquid crystal panel, and serves to carry out image display by controlling transmission or shielding (blocking) of the light, through a liquid crystal panel, emitted from a backlight arranged on a back face of the liquid crystal panel.

A plurality of light emitting diodes (hereinafter, LEDs: Light Emitting Diodes) are used as light sources of a backlight. As LEDs used for light sources, there are, for example, white LEDs, color LEDs composed of three primary colors of red LEDs, green LEDs and blue LEDs, etc.

Adjustment methods for the brightness (luminance) and color of LEDs include current value control, PWM (Pulse Width Modulation) control, and so on. In PWM control, adjustment of brightness or white balance is carried out by adjusting the duty ratio of a turn-on period of time and a turn-off period of time of each LED.

The brightness (luminance) of LEDs changes according to the temperature characteristics of their devices, or the aged deterioration of long-term use, and besides their individual differences. Accordingly, there is a technique in which, in order to maintain the brightness or brightness of a backlight constant, feedback control is carried out on the backlight by using various kinds of sensors such as brightness sensors arranged in a backlight housing.

In addition, there is also a technique in which a backlight is divided into a plurality of blocks, and light emissions of light sources are controlled independently of one another for each of the blocks. According to this technique, it becomes possible to perform, for example, local dimming control in which the brightnesses of light sources are made to differ for each block according to an image signal to be inputted, in such a manner that the brightness of a light source for a block corresponding to a low gradation (gray level) portion is made low, whereas the brightness of a light source for a block corresponding to a high gradation portion is made high. In such a backlight, it is desirable to obtain a measured value of brightness for each block by means of a sensor, and to carry out feedback control for the stabilization of brightness based on the measured brightness value thus obtained.

In the feedback control for stabilizing the brightness of a backlight, the following method is known as a method of measuring the brightness for each block. That is, the method is such that those blocks other than a block to be measured (hereinafter also referred to as a measurement target block) are caused to turn off for a short period of time such as, for example, hundreds of microseconds, in order to remove the influence of ambient light, and then, the brightness of the measurement target block is measured during this period of time. However, it is found that this method has a problem to produce a flicker.

FIG. 13 is a view showing an example of the construction of a backlight and the order in which the measurement of brightness of each block is carried out by means of sensors, according to a conventional technology. In the example shown in FIG. 13, the backlight is composed of a total of 160 blocks including 16 pieces in the horizontal or transverse direction and 10 pieces in the vertical direction. In addition, acquisition of sensor values for each block is individually carried out on each of a left side surface (L) and a right side surface (R) of the backlight. FIG. 13 shows the order of acquiring the sensor values of the blocks on the left side surface for simplification of drawing. In the example shown in FIG. 13, with respect to the left side surface of the backlight, the acquisition of the sensor values is carried out in a sequential manner from an upper left block (sensor value acquisition start block) toward a lower end central block (sensor value acquisition end block). A set of 16 blocks in the transverse direction is called a "line", and a set of 10 blocks in the vertical direction is called a "column". In FIG. 13, line numbers 1 through 10 are given in order from the top of the backlight. In the left side surface, a block in the nth line from the top and in the mth column from the left side end is represented by a symbol L [m] [n]. Those blocks belonging to the same line are assumed to be driven and controlled by PWM signals at the same timing, respectively.

FIG. 14 is a timing chart which shows an example of PWM control of the backlight in the conventional technology shown in FIG. 13. In the example of FIG. 14, one frame period (60 Hz) is divided into five subframe periods (300 Hz), and the start timing of a turn-on period of time of PWM control is shifted line by line within one subframe period. According to this, turn-on control of the backlight is carried out in such a manner that those lines to be turned on within one subframe period move downward from the top to the bottom of the backlight (details will be described later by using FIG. 3 and FIG. 4). In general, PWM control is carried out for each line (i.e., line by line), but in cases where sensor values are acquired for each block (i.e., block by block), only a sensor value acquisition target block for which a sensor value is to be acquired is turned on, and those blocks other than the target block in a line to which the target block belongs are all turned off. In addition, those lines other than the line to which the sensor value acquisition target block belongs are also turned off.

FIG. 14 schematically shows an example of the timing chart which illustrates the PWM control of the backlight at the time of carrying out the acquisition of the sensor values of the blocks which belong to line 1. Here, it is assumed that a sensor value acquisition target block is caused to move for each subframe (i.e., subframe by subframe) in the order shown in FIG. 13. In a sensor value acquisition period in which a sensor value for a sensor value acquisition target block is acquired, those lines other than a line (e.g., line 1) to which the sensor value acquisition target block belongs are altogether turned off, including the lines (e.g., lines 8 through 10), too, which are originally to be turned on (i.e., in the turn-on period of time). In addition, even in the line 1, those blocks other than the sensor value acquisition target block are all turned off. For example, in cases where a block L [1] [1] at the left side end of the line 1 is the sensor value acquisition target block, the other blocks L [1] [n] (n=2 through 8) which belong to the line are turned off.

In FIG. 14, a portion indicating the PWM control of the line 1 is assumed to represent the PWM control of the sensor value acquisition target block in particular among the blocks belonging to the line 1. As mentioned above, the sensor value acquisition target block moves subframe by subframe, as shown in FIG. 13, so the PWM control described in the line 1 in FIG. 14 represents the PWM control of a different block for each subframe. For example, the portion of the first subframe represents the PWM control of a block L [1] [1] of the line 1. The PWM control of the other blocks L [1] [n] (n=2 through 8) in the line 1 is forced to turn off, similar to the lines through 10. The portion of the second subframe represents the PWM control of a block L [1] [2] of the line 1, and the PWM control of the other blocks L [1] [n] (n=1, 3 through 8) in the line 1 is forced to turn off. Thus, in a precise sense, in a line including a sensor value acquisition target block, PWM control is different for between the sensor value acquisition target block and the other blocks, but in FIG. 14, the description thereof is omitted in order to simplify the illustration.

FIG. 15 is a view schematically showing a temporal change in the turn-on states of the left side surface of the backlight in the case of carrying out the acquisition of sensor values of the blocks belonging to the line 1 of the backlight according to the timing chart shown in FIG. 14. Here, note that in FIG. 15, for the sake of simplified illustration, only a sensor value acquisition period and turn-on states immediately before and immediately after each sensor value acquisition period are extracted and described from among each subframe period. For example, in the first subframe period, there are described only a turn-on state at the time of carrying out sensor value acquisition for a block at the first column in the line 1 and turn-on states in which the lines 1, 8 through 10 are turned on immediately therebefore and immediately thereafter. After this, in actuality, a period of time in which the lines 1, 2, 9 and 10 are turned on, a period of time in which the lines 1, 2, 3 and 10 are turned on, and so on continue, but the description thereof is omitted.

In the first subframe period shown in FIG. 15, the lines 1, 8 through 10 are first turned on, and after the lapse of a predetermined period of time, a sensor value acquisition period in the line 1 comes, so that only a first sensor value acquisition target block L [1] [1] in the line 1 is turned on. In this sensor value acquisition period, the lines 8 through 10 and the blocks other than the block L [1] [1] in the line 1, which are originally in their turn-on periods of time, are all forced to turn off. At timing immediately after the end of this sensor value acquisition period, the lines 1, 8 through 10 are turned on again. In the second subframe period in FIG. 15, the lines 1, 8 through 10 are first turned on, and after the lapse of the predetermined period of time, a sensor value acquisition period in the line 1 comes, so that only the following sensor value acquisition target block L [1] [2] in the line 1 is turned on. In this sensor value acquisition period, the lines 8 through 10 and the blocks other than the block L [1] [2] in the line 1, which are originally in their turn-on periods of time, are all forced to turnoff. At timing immediately after the end of this sensor value acquisition period, the lines 1, 8 through 10 are turned on again.

During a period of time over a plurality of subframes in which measurements of the brightness of each block in the line 1 are carried out in this manner, forced turn-off periods of time are inserted in the turn-on periods of time of the lines 8 through 10 for each subframe, a large brightness variation will occur in a periodic manner. This may be recognized as a flicker.

In the examples of FIG. 14 and FIG. 15, in each sensor value acquisition period of the line 1, what is forced to turn off is the blocks in the three lines of the lines 8 through 10, but when a PWM control value (duty ratio) becomes a large value, the number of lines to be forcibly turned off in the sensor value acquisition periods will increase. For that reason, a brightness change between each sensor value acquisition period and each of the other periods will be larger, so it becomes easy to be recognized as a flicker.

However, human reaction to light is due to an amount of light which is obtained by integrating the light received by the eyes over a period of time of about 1/60 seconds. In addition, in cases where brightness changes rapidly between high intensity and low intensity, in particular in response to interruption of light, it is easy for human beings to recognize such a change as a flicker.

Japanese patent No. 4094952 describes a technique of reducing a flicker at the time of acquiring sensor values. In the technique described in this patent No. 4094952, in a white lighting apparatus using LEDs (Light Emitting Diodes) of R (red), G (green), and B (blue) as light sources, acquisition of sensor values is carried out during a measurement cycle of an LED of a certain color, by putting LEDs of the other two colors into off states. In this case, in the technique described in the above-mentioned patent No. 4094952, immediately before and immediately after the time when the LEDs of the other two colors are put into turn-off states, the intensities of the LEDs of the other two colors are caused to increase to a slight extent.

SUMMARY OF THE INVENTION

However, in the above-mentioned conventional technique, some LEDs are caused to increase their brightness for a moment and are then put into off states, so that a change in brightness becomes large all the more and may be recognized as a flicker.

In addition, with a lighting apparatus such as a backlight apparatus in which LEDs are arranged as a surface, LEDs in a certain region are controlled to turn on and off, as shown in FIG. 15, so that the surface brightness of the certain region will vary in a periodic manner over a fixed period of time due to such on and off control. This may be recognized as a flicker.

In view of the above-mentioned problems, the present invention has for its object to provide a new and improved technique which, in a lighting apparatus having a plurality of light sources and sensors for measuring brightness of the light sources, serves to suppress the occurrence of a flicker at the time of acquiring a sensor value of the brightness of each light source.

A first aspect of the present invention resides in a lighting apparatus which is provided with:

a plurality of light sources of which emissions of light are able to be controlled independently of one another;

a control unit configured to control brightness of each of said light sources; and a measurement unit configured to measure the brightness of each of said light sources;

wherein in cases where the brightness of each of said light sources is measured by said measurement unit, said control unit carries out a first control which causes a measurement target light source to turn on and at the same time light sources other than said measurement target light source to turn off, and a second control which decreases the brightness of each of the light sources in a stepwise manner immediately before a turn-off period of time thereof, and which increases the brightness of each of the light sources in a stepwise manner immediately after the turn-off period of time.

A second aspect of the present invention resides in a control method for a lighting apparatus which is provided with a plurality of light sources of which emissions of light are able to be controlled independently of one another, said method including:

a control step of controlling brightness of each of said light sources; and a measurement step of measuring the brightness of each of said light sources;

wherein said control step includes:

a first control step of causing a measurement target light source to turn on and at the same time light sources other than said measurement target light source to turn off, in cases where the brightness of each of said light sources is measured in said measurement step; and a second control step of decreasing the brightness of each of the light sources in a stepwise manner immediately before a turn-off period of time thereof, and increasing the brightness of each of the light sources in a stepwise manner immediately after the turn-off period of time.

According to the present invention, in a lighting apparatus having a plurality of light sources and sensors for measuring brightness of the light sources, it is possible to suppress the occurrence of a flicker at the time of acquiring a sensor value of the brightness of each light source.

Further features of the present invention will become apparent from the following description of exemplary embodiments with reference to the attached drawings.

DESCRIPTION OF THE EMBODIMENTS

First Embodiment

Hereinafter, the best mode of embodiments carrying out the present invention will be described in detail by way of example with reference to the attached drawings. However, the function, relative arrangement and so on of component parts described in the embodiments are not intended to limit the scope of the present invention to these alone as long as there are no specific statements. In addition, in the following description, it is assumed, unless particularly described as otherwise, that the construction, configuration, function, shape and so on of each component part, which are once described, are the same as in the first explanation.

Figure 1:
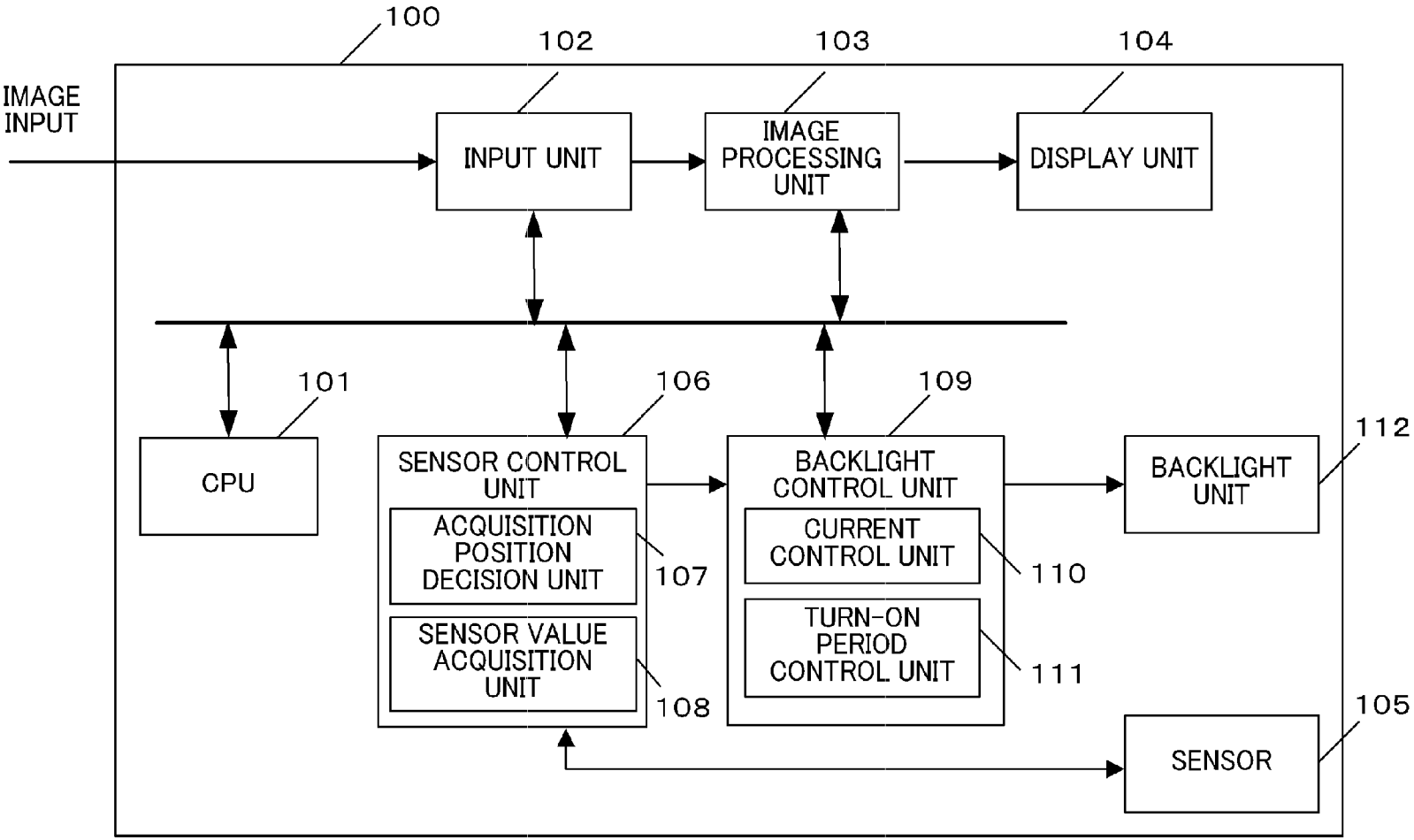
FIG. 1 is a block diagram showing a construction example of a display device according to a first embodiment of the present invention.

FIG. 1 is a block diagram showing a construction example of a display device 100 to which the present invention can be applied.

A ROM and a RAM, which are not shown, are connected to a CPU 101, so that the CPU 101 controls an overall operation of the display device 100 according to programs stored in the ROM, while using the RAM as a work memory.

An input unit 102 decodes an image signal inputted thereto from an unillustrated image output device, and outputs the image signal thus decoded to an image processing unit 103.

The image processing unit 103 carries out image processing such as contrast control, gamma adjustment, etc., on the inputted image signal, and thereafter outputs the image signal thus processed to a display unit 104.

The display unit 104 is composed of a liquid crystal panel, and is subjected to display control which is carried out by adjusting the transmittance of each pixel based on the image signal inputted from the image processing unit 103.

A sensor 105 is provided with a plurality of brightness (luminance) sensors, each of which measures the brightness for each light emission block of a backlight unit 112 (a lighting apparatus (a lighting device); a light emitting apparatus (a light emitting device)), and the plurality of brightness sensors are arranged or mounted on the backlight unit 112 which will be described later. Here, note that the sensor 105 may further include temperature sensors. In that case, the temperature sensors may be used to compensate for the temperature characteristics of the brightness sensors or LEDs (Light Emitting Diodes).

A sensor control unit 106 is provided with an acquisition position decision unit 107 and a sensor value acquisition unit 108.

The sensor control unit 106 decides a block of the backlight unit 112 which becomes a target for which a sensor value is acquired, i.e., a brightness measurement target, according to a sensor value acquisition target block decision procedure to be described later by means of the acquisition position decision unit 107. In addition, the sensor control unit 106 acquires and holds sensor values from the sensor 105 by means of the sensor value acquisition unit 108.

When having acquired the sensor values for the entire blocks of the backlight unit 112, the sensor control unit 106 outputs the sensor values thus acquired to the backlight control unit 109, then clears the sensor values currently held, and resumes sensor value acquisition processing.

A vertical synchronizing signal of the image signal outputted from the image processing unit 103 to the display unit 104 is inputted to the sensor control unit 106, and the sensor control unit 106 carries out timer interrupt setting for the notice of sensor value acquisition timing with respect to the CPU 101 by using the vertical synchronizing signal as a trigger.

In this embodiment, it is assumed that the timer interrupt setting is carried out in a cycle of 300 Hz, and sensor values for 5 blocks per frame are acquired by the sensor value acquisition unit 108 according to a timer interrupt.

Here, note that in this embodiment, the above-mentioned timer interrupt setting for the notice of sensor value acquisition timing is assumed to be carried out based on an input of a first vertical synchronizing signal from the image processing unit 103 to the sensor control unit 106, after the display device is actuated.

In addition, when a sensor value is acquired, the sensor control unit 106 notifies the position information and acquisition timing of a block of the backlight unit 112, which becomes a sensor value acquisition target, to the backlight control unit 109.

Based on the inputted sensor value, the backlight control unit 109 calculates a current value and a control value (duty ratio) of PWM control (pulse width modulation control) for each block, in such a manner that the brightness of each block of the backlight unit 112 becomes a target brightness. The backlight control unit 109 carries out driving control on LEDs of each of the blocks which constitute the backlight unit 112, by means of an electric current control unit 110 and a turn-on period control unit 111.

In addition, at the sensor value acquisition timing notified from the sensor control unit 106, the backlight control unit 109 controls the LEDs of those blocks other than the sensor value acquisition target block so that they are caused to turn off.

Here, note that the vertical synchronizing signal of the image signal outputted from the image processing unit 103 to the display unit 104 is inputted to the backlight control unit 109, and the backlight control unit 109 updates the PWM control value at the input timing of the vertical synchronizing signal.

Figure 2:
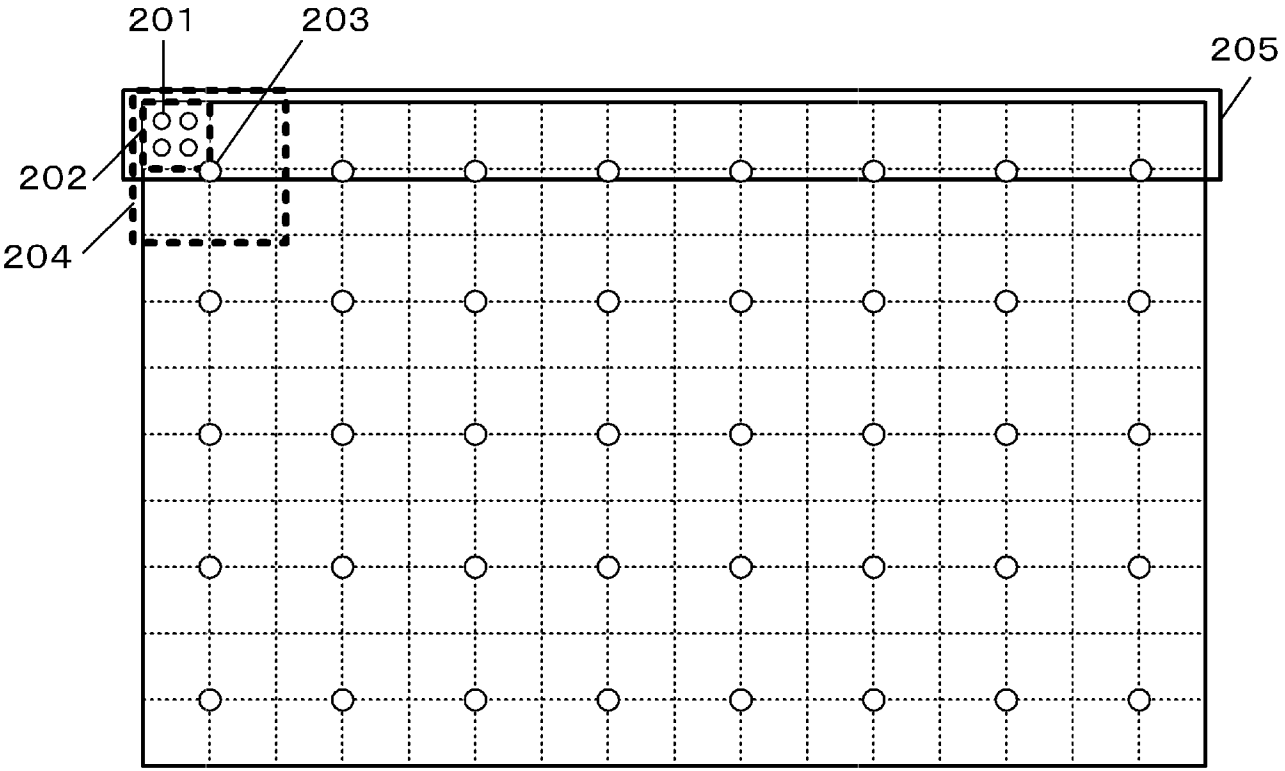
FIG. 2 is a view showing a construction example of a backlight unit according to the first embodiment of the present invention.

FIG. 2 is a view showing a construction example of the backlight unit 112.

In this embodiment, the backlight unit 112 is provided with white LEDs 201 as light sources, wherein four white LEDs 201 together constitute a control unit of the backlight unit 112, i.e., a block 202 which is a light emission block, of which the emission of light can be controlled independently. In addition, the backlight unit 112 is composed of a total of 160 blocks including 10 pieces in the vertical direction and 16 pieces in the horizontal or transverse direction.

Further, in the backlight unit 112, sensors 203 each having one set of a brightness (luminance) sensor and a temperature sensor are arranged one for each assembly 204 which is composed of a total of four blocks including two pieces in the vertical direction and two pieces in the horizontal or transverse direction. Each of the sensors 203 can detect the brightness of each of four blocks arranged adjacent to the sensor 203.

Here, in this embodiment, a set of 16 blocks in the transverse direction of the screen is defined as a line 205, and those blocks belonging to the same line are assumed to be driven and controlled by PWM signals at the same timing, respectively. A set of blocks in the vertical direction is called a "column". The lines are sequentially defined as line 1, line 2, . . . , line 10 in order from the top to the bottom of the backlight unit 112.

Figure 3:
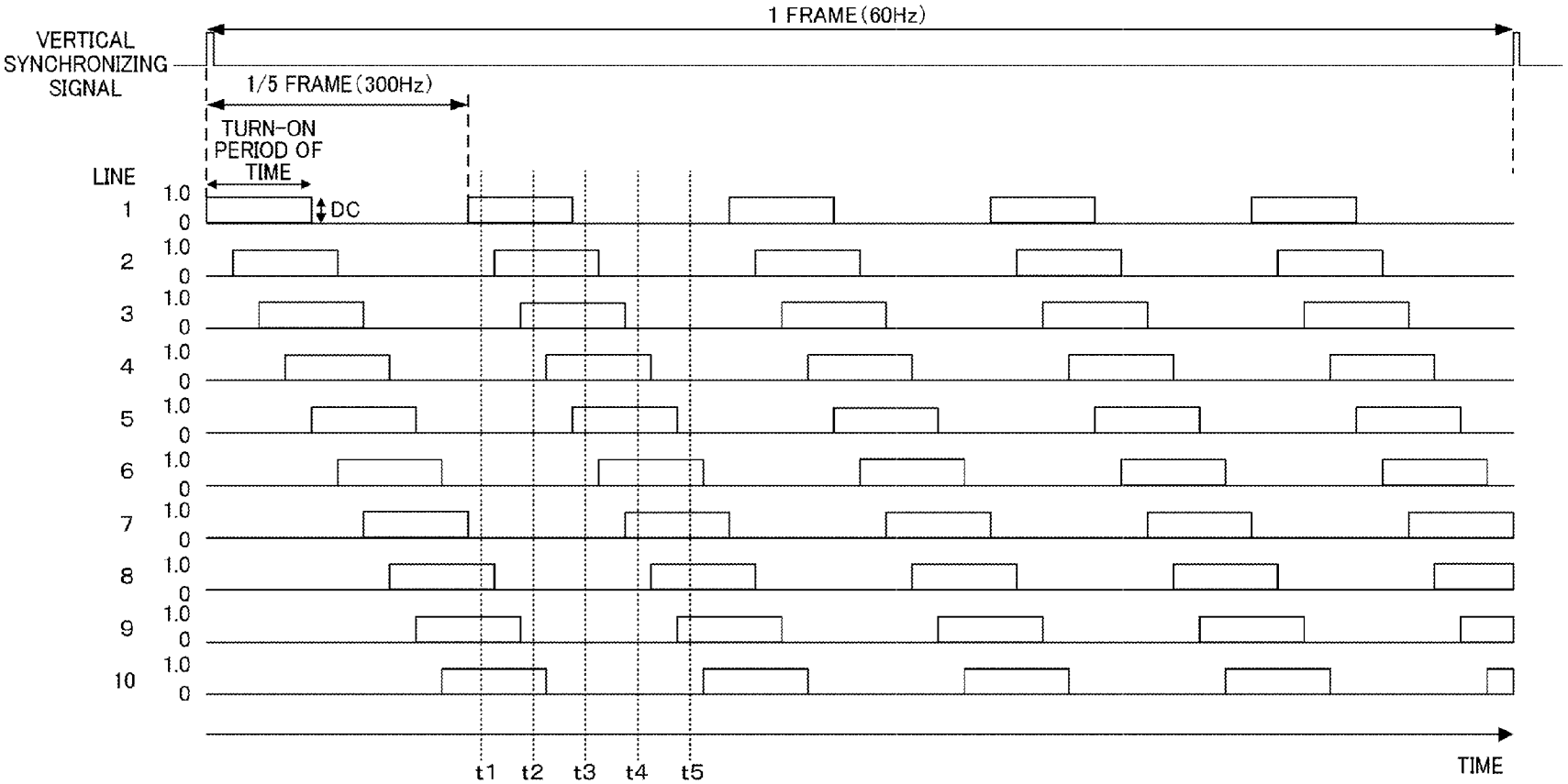
FIG. 3 is a timing chart of PWM control of the backlight unit according to the first embodiment of the present invention.
Figure 4A:
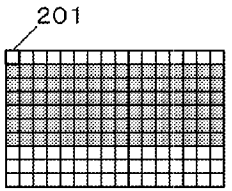
FIGS. 4A through 4E are views showing turn-on states of the backlight unit at time points t1 through t5 in FIG. 3, respectively.
Figure 4B:
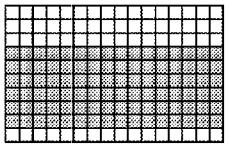
Figure 4C:
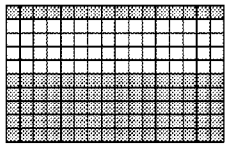
Figure 4D:
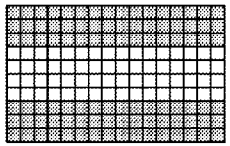
Figure 4E:
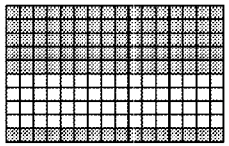

FIG. 3 is a timing chart of PWM control with respect to each block in the first column at the left end of the backlight.

Here, in this embodiment, it is assumed that the backlight control unit 109 divides one frame period (60 Hz) into five subframe periods (300 Hz), and carries out driving control of the LEDs of the backlight unit 112 with the same PWM control value in each subframe period. In the timing chart of PWM control in FIG. 3, a current value (hereinafter described as DC) 1.0 represents an on state (a turn-on period of time) of an LED, and a DC 0 represents an off state (a turn-off period of time). Here, note that 1 frame period and 1 subframe period are merely examples, and the present invention can be applied without limiting to the above-mentioned example.

The backlight control unit 109 moves the lines to be turned on in order from the top to the bottom of the backlight unit 112 in a sequential manner, while shifting the start timing of a turn-on period of time of PWM control line by line within the same cycle (here, within one subframe period). With respect to the line 1, the backlight control unit 109 puts LEDs into an on state in synchronization with the timing at which the vertical synchronizing signal becomes high, and then puts the LEDs into an off state after a predetermined turn-on period of time decided by a duty ratio elapses. Each time N/5 frame period (N is 1 through 4) elapses from the timing at which the vertical synchronizing signal becomes high, the backlight control unit 109 puts LEDs in the line 1 into the on state again, and then puts them into the off state after the predetermined turn-on period of time elapses, in a repeated manner.

With respect to the line 2, the backlight control unit 109 puts LEDs into an on state after a predetermined period of time (a delay time) elapses with respect to the timing at which the line 1 is turned on, and then puts the LEDs into an off state after a predetermined turn-on period of time decided by a duty ratio elapses. Hereafter, the backlight control unit 109 carries out the turn-on control of each line in a similar manner. The backlight control unit 109 controls the turn-on start timing for each line in such a manner that as the line number increases, the delay time with respect to the turn-on start timing of the line 1 becomes longer.

FIGS. 4A through 4E are views showing turn-on states of the backlight unit 112 at time points t1 through t5 in FIG. 3, respectively. As shown in FIGS. 4A through 4E, the lines to be turned on move in order from the top to the bottom of the backlight unit 112 in a sequential manner.

Figure 5:
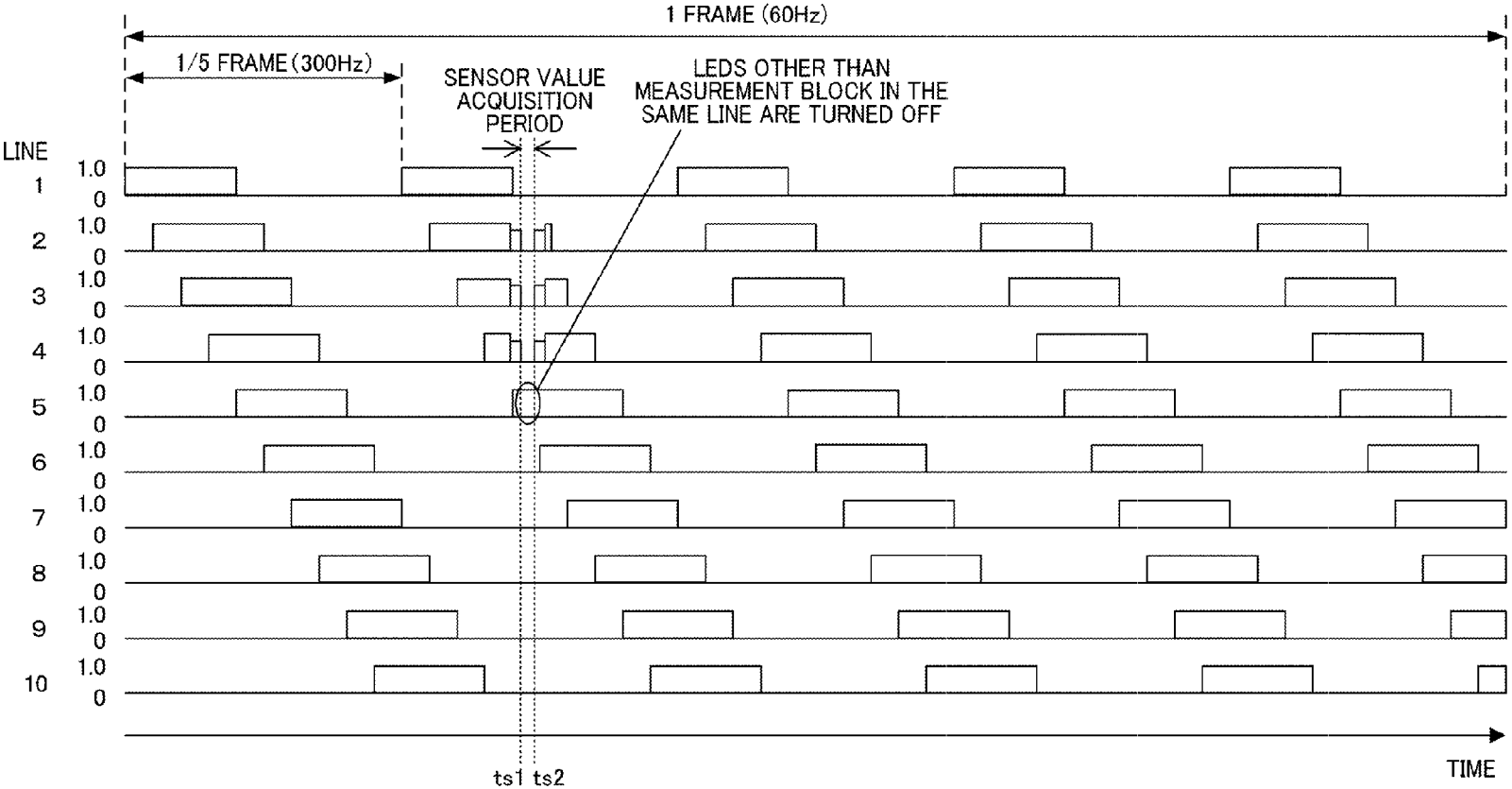
FIG. 5 is a timing chart at the time of acquiring a sensor value of a block in the first column at the left side end of a line 5.

FIG. 5 is a timing chart showing PWM control at the time of acquiring a sensor value of a block in the first column at the left side end of a line 5.

In the duration of time points ts1 to ts2 which are in a sensor value acquisition period, the backlight control unit 109 turns on only a block for which a sensor value is to be acquired (i.e., a sensor value acquisition target block), and turns off all the other blocks. That is, those blocks other than the sensor value acquisition target block which are in the line to which the sensor value acquisition target block belongs, and those blocks which are in the lines other than the line to which the sensor value acquisition target block belongs and which belong to those lines which are originally in the turn-on period of time, are all turned off as blocks to be forced to turn off (forced turn-off target blocks). Those blocks belonging to the lines which are originally in the turn-off period of time are turned off as in the original control.

The sensor control unit 106 acquires the sensor value of the sensor value acquisition target block in a forced turn-off period of time in which LEDs in those blocks other than the sensor value acquisition target block are in the off state.

A portion indicating the PWM control of the line 5 in FIG. 5 is assumed to represent the PWM control of the sensor value acquisition target block in particular among the blocks belonging to the line 5. That is, those blocks other than the sensor value acquisition target block among the blocks belonging to the line 5 are turned off, similar to the lines 2 through 4, but the description thereof in FIG. 5 is omitted in order to simplify the illustration.

Figure 6:
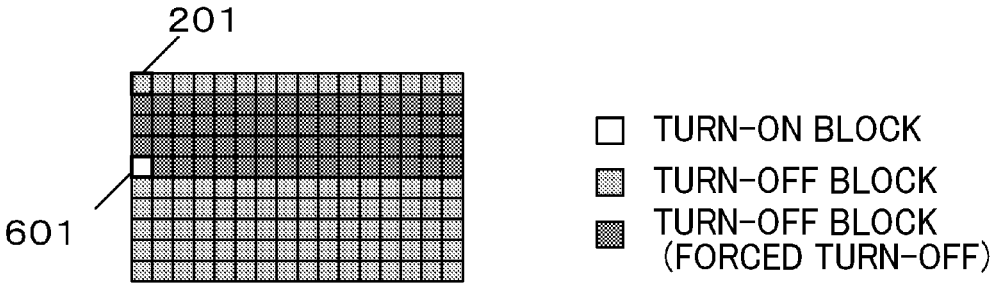
FIG. 6 is a view showing a turn-on state at the time of acquiring a sensor value of a block in the first column at the left side end of the line 5.

FIG. 6 is a view schematically showing the turn-on states of the backlight unit 112 in a period of time in which the sensor value of the block in the first column at the left side end of the line 5 is acquired. As shown in FIG. 6, in the sensor value acquisition period of the block in the first column at the left side end of the line 5, LEDs of the block through the block 4 which are originally in the turn-on period of time, and LEDs of the blocks in the line 5 other than the block in the first column at the left end (601 of FIG. 6) are all forced to turn off.

Figure 7:
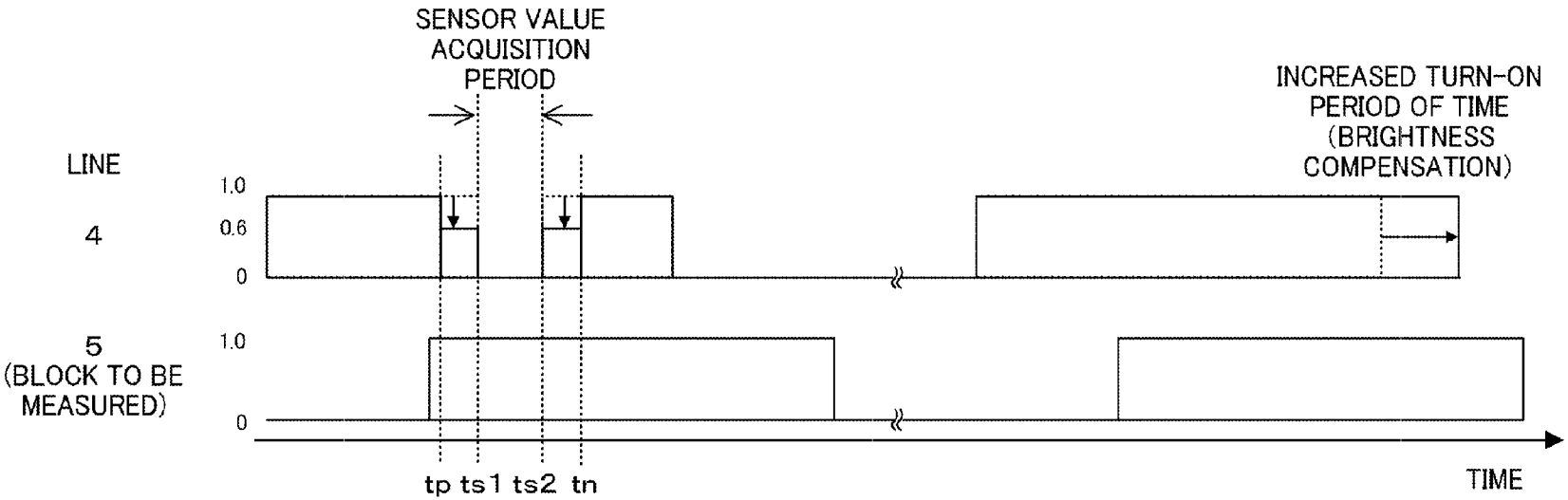
FIG. 7 is a view showing an example of turn-on control of a line 4 which is turned off in a sensor value acquisition period of the line 5.

FIG. 7 is a view in which the portions of the line 4 and the line 5 in particular within the PWM control timing chart shown in FIG. 5 are extracted and shown for explanation.

At time points tp through ts1 and at time points ts2 through tn, which are before and after the sensor value acquisition period, respectively, the backlight control unit 109 sets the current value for driving the LEDs of the blocks in the line 4 to a current value (0.6) lower than an original current value (1.0). Here, note that the decreased amount of the current value is merely an example, and is not limited to this example. By lowering the current value for driving the LEDs of the blocks in the line 4 before and after the sensor value acquisition period in this manner, it is possible to suppress a rapid brightness (luminance) decrease or increase in the line 4 before and after the sensor value acquisition period.

Here, note that in FIG. 7, the current value at time points tp through ts1 and the current value at time points ts2 through tn are made the same, but a change from low brightness (luminance) to high brightness (luminance) can be visually recognized more easily than a change in the reverse direction, so the current value at time points tp through ts1 may be set to be lower in comparison with the current value at time points ts2 through tn.

Figure 8:
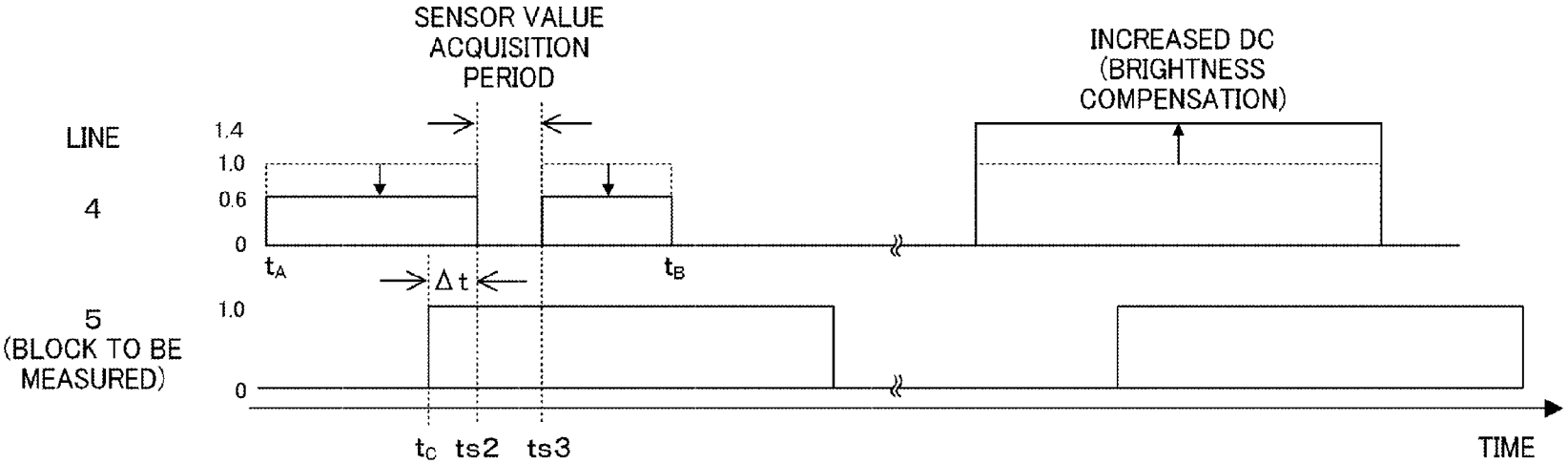
FIG. 8 is a view showing another example of turn-on control of the line 4 which is turned off in a sensor value acquisition period of the line 5.

FIG. 8 is another view in which the portions of the line 4 and the line 5 in particular within the PWM control timing chart shown in FIG. 5 are extracted and shown for explanation.

In an example of FIG. 8, the backlight control unit 109 lowers the emission intensity (current value) for an entire subframe period in those lines, such as the line 4, which include a period of time forced to turn off for the sensor value acquisition of other line (here, the line 5) within the turn-on period of time. As a result of this, a brightness step or difference at the time of switching between the turning-on and turning-off of the line 4 is reduced.

As shown in FIG. 7 and FIG. 8, in the PWM control of the lines which are forced to turn off, brightness compensation may be carried out in cycles including and following a cycle in which the forced turn-off has been carried out (i.e., a subframe period in which the forced turn-off has been carried out or the following subframe period). The brightness compensation can be carried out, for example, by increasing the PWM control value (FIG. 7) or increasing the current value (FIG. 8). This also makes it possible to compensate for the brightness (luminance) decrease due to the forced turn-off. In both of FIG. 7 and FIG. 8, the timing at which the current value or the PWM control value is increased to compensate for the brightness decrease for the turn-off period of time is in a subframe following the subframe including the turn-off period of time, but in addition to this, the subframe including the turn-off period of time may also be added. Moreover, in FIG. 7, the compensation of the brightness decrease may be only for an amount of brightness decrease in a turn-off period of time from time point ts1 to time point ts2, or in addition to this, an amount of brightness decrease in a period of time from time point tp to time point ts1 and/or an amount of brightness decrease in a period of time from time point ts2 to time point to may be added. In FIG. 8, the compensation of the brightness decrease may be only for an amount of brightness decrease in a turn-off period of time from time point ts2 to time point ts3, or in addition, an amount of brightness decrease in a period of time from time point tA, at which the turn-on of the subframe including the turn-off period of time starts, to time point ts2, or an amount of brightness decrease in a period of time from time point ts3 to time point tB, at which the turn-on of the subframe including the turn-off period of time ends, may be added.

Next, reference will be made to the operation of the acquisition position decision unit 107.

Figure 9:
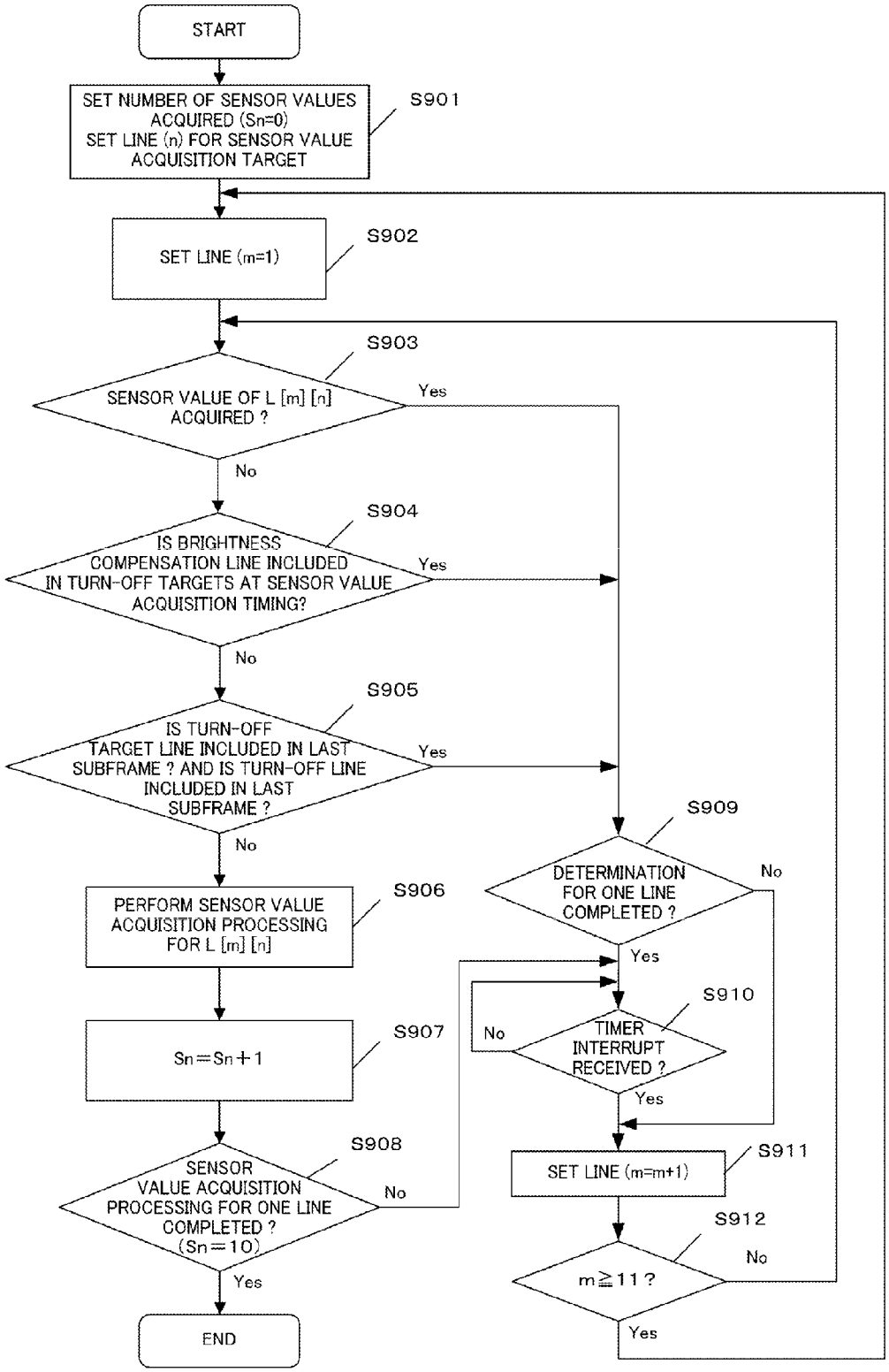
FIG. 9 is a flow chart of the decision procedure of a sensor value acquisition target block in the first embodiment of the present invention.

FIG. 9 is a flow chart showing the decision procedure of a sensor value acquisition target block by means of the acquisition position decision unit 107.

Figure 11:
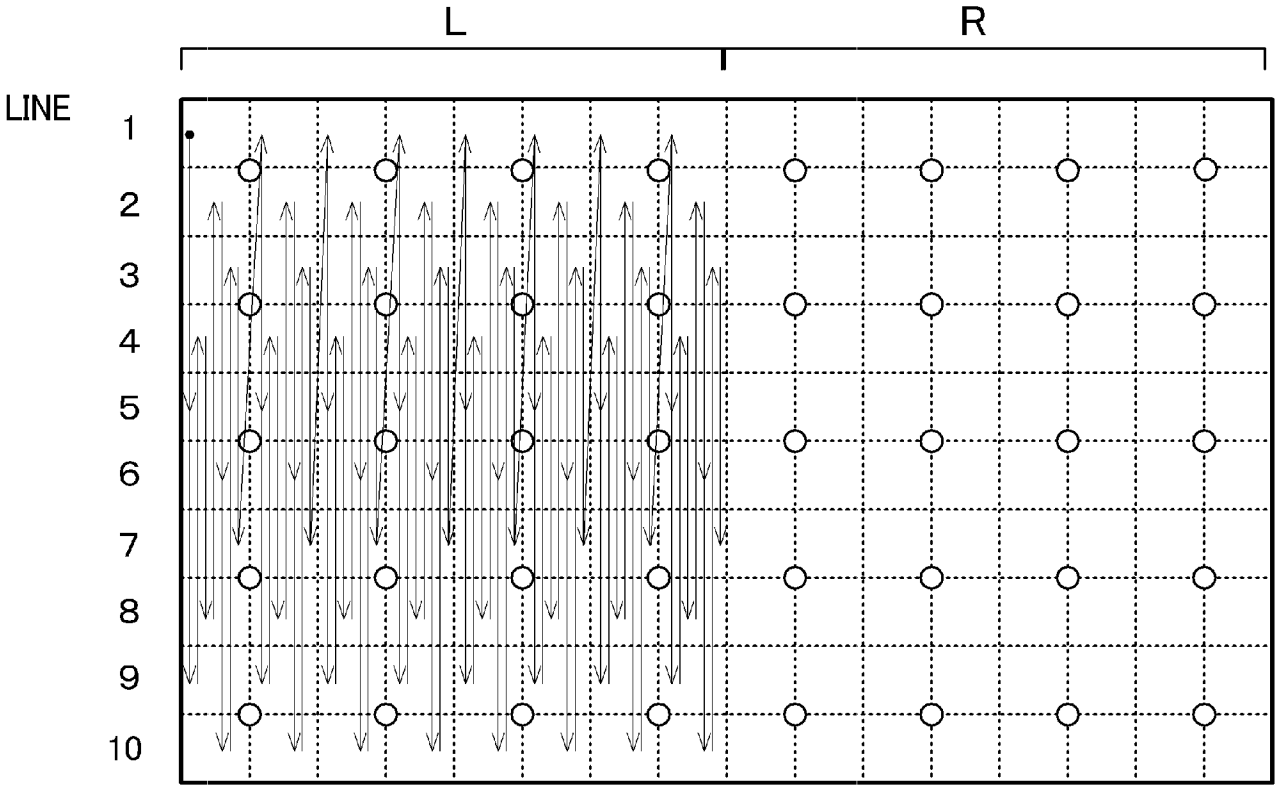
FIG. 11 is a view showing an example of an order at the time of acquiring sensor values in the first embodiment of the present invention.

Here, note that in this embodiment, the backlight unit 112 is constructed such that it is divided into two, i.e., the left side surface (L) and the right side surface (R), and sensor value acquisition is carried out by each of the right and left opposite side surfaces, respectively, at the same time. FIG. 11 shows how to divide the left side surface and the right side surface of the backlight unit 112. As shown in FIG. 11, the left side surface and the right side surface are each composed of a total of 80 blocks including 8 pieces in the horizontal or transverse direction and 10 pieces in the vertical direction.

The processing of this flow chart is started by a trigger of receiving a first timer interrupt for use as sensor value acquisition timing, with respect to an arbitrary column. In this embodiment, acquisition of a sensor value is carried out for each column. The order of columns in which the acquisition of a sensor value is carried out is not limited in particular. The column in which sensor value acquisition is carried out may be moved in order from a left end column to a right end column in a sequential manner, or may be moved in other order than that.

The acquisition position decision unit 107 first sets the number of acquired sensor values (Sn) to 0, and also sets the column number (n) (n=1-8) in which a sensor value is acquired (step S901).

Then, the acquisition position decision unit 107 sets the line number (m) of a block for which a determination is made as to whether the block is set as a sensor value acquisition target or not (step S902). In this embodiment, it is assumed that a determination as to whether a block is set as a sensor value acquisition target is carried out from the blocks in the line 1, and in step S902, the line number (m) is set to 1 (m=1). However, this is merely an example, and a determination as to whether a block is set as a sensor value acquisition target is carried out from which line number is not limited to this example.

Here, a block of column number n and line number m in the left side surface of the backlight unit 112, i.e., a block located at the n-th position from the left end and at the m-th position from the top in the left side surface, is represented by L [m] [n]. For example, a block located at the first column from the left end in the line 1, i.e., a block at the leftmost and uppermost position of the backlight unit 112, is expressed as L [1] [1].

Subsequently, the acquisition position decision unit 107 determines whether the sensor value of the block L [m] [n] has already acquired (step S903). In cases where the sensor value of the block L [m] [n] has not yet been acquired, the acquisition position decision unit 107 (or the control flow) advances to step S904, whereas in cases where it has already been acquired, the control flow advances to step S909.

The acquisition position decision unit 107 determines whether the line for which PWM control for brightness compensation is carried out is included in those lines which become targets to be forced to turn off at the timing at which the sensor value of the block L [m] [n] is acquired (step S904). In cases where the above condition is satisfied, the acquisition position decision unit 107 (the control flow) advances to step S909.

As mentioned above, in this embodiment, in order to compensate for an amount of brightness decrease in an area which is forced to turn off at the time of acquiring a sensor value of a certain block, the backlight control unit 109 can carry out PWM control for performing brightness compensation, for example, in a subframe following a subframe which is included in the area (refer to FIG. 7 and FIG. 8). In this case, when the line in which PWM control for brightness compensation is carried out is again forced to turn off for the acquisition of a sensor value of another block, the brightness compensation may not be carried out to a sufficient extent. Accordingly, in this embodiment, in cases where, based on the determination of the above-mentioned step S904, a determination is made that such a situation occurs due to the acquisition of the sensor value of the block L [m] [n], the acquisition of the sensor value of the block L [m] [n] is not carried out in the current subframe. As a result of this, the line in which PWM control for brightness compensation is carried out is suppressed from being turned off.

The acquisition position decision unit 107 determines whether a turn-on period of time in a line, which becomes a target to be forced to turn off at the timing at which the sensor value of the block L [m] [n] is acquired, belong to the one preceding subframe, and whether there exists any line which was forced to turn off in the last subframe (step S905). Here, "a turn-on period of time belongs to the one preceding subframe" is that the start timing of that turn-on period of time is within the one preceding subframe period. In addition, "the line which was forced to turn off in the last subframe" is a line which started to turn on within the last subframe period, and which became a target forced to be turn off accompanying the sensor value acquisition of a block in another line. In cases where the above condition is satisfied, the acquisition position decision unit 107 (the control flow) shifts to step S909.

Here, in this embodiment, it is assumed that the sensor value acquisition timing (time point ts2, in the case of the line 5 in FIG. 8) is set as timing at which a predetermined period of time (Δt, in the case of the line 5 in FIG. 8) has elapsed from start timing of the turn-on period of time (time point tc, in the case of the line 5 in FIG. 8). Then, this predetermined period of time Δt is assumed to be timing which is close to the start timing of the turn-on period of time. For example, in cases where sensor value acquisition in the line 1 is carried out in the second subframe in FIG. 3 (a subframe in which time points t1 through t5 are included), the time point t1 is assumed to be sensor value acquisition timing. In addition, in cases where sensor value acquisition in the line 3 is carried out, time point t2 is assumed to be sensor value acquisition timing. In this case, as shown in FIG. 3, the sensor value acquisition timing t1 in the line 1 is included in the turn-on periods of time in the lines 8 through 10 in the one preceding subframe. Also, the sensor value acquisition timing t2 in the line 3 is included in the turn-on period of time in the line 10 in the one preceding subframe. Thus, in the example of FIG. 3, when a sensor value in any of the lines 1 through 3 in a certain subframe is to be acquired, either of the lines 8 through 10, which started to turn on in the one preceding subframe, will be forced to turn off irrespective of the presence or absence of a brightness compensation period.

In this embodiment, the occurrence of a subframe of which brightness decreases to a large extent is suppressed, by preventing two or more turn-on periods of time which are forced to turn off accompanying sensor value acquisition from belonging to one subframe. That is, let us consider a case where there is a line which was forced to turn off accompanying sensor value acquisition in another line, among those lines which started to turn on in the one preceding subframe. In this case, when either of the lines which started to turn on in the one preceding subframe, is caused to further turn off accompanying the sensor value acquisition of the current subframe, the decrease of brightness in the one preceding subframe will become large. Accordingly, in this embodiment, in cases where, based on the determination of the above-mentioned step S905, a determination is made that such a situation occurs due to the acquisition of the sensor value of the block L [m] [n], the acquisition of the sensor value of the block L [m] [n] is not carried out in the current subframe. This serves to suppress the occurrence of a subframe in which the decrease of brightness becomes large.

When the block L [m] [n] is decided as a sensor value acquisition target block, based on the result of the above-mentioned determination, the sensor value acquisition unit 108 carries out acquisition processing of the sensor value of the block L [m] [n] (step S906).

When the sensor value of the block L [m] [n] is acquired by the sensor value acquisition unit 108, the acquisition position decision unit 107 increments the number of acquired sensor values (Sn) (step S907), and determines whether the sensor values of all the blocks in one column have been acquired (step S908). In the case of this embodiment, one column has ten blocks, and hence, when Sn=10, a determination is made that the acquisition of the sensor values of all the blocks in the one column has been completed. When the acquisition of the sensor values for the one column has been completed, the processing of this flow is ended, and thereafter, the processing of this flow will be again started by timer interrupt according to a vertical synchronizing signal inputted next.

In step S909, it is determined whether determinations for sensor value acquisition target blocks according to step S903 through step S905 have been carried out for one column. For example, it is determined whether the blocks L [1] [n] through L [10] [n] (here, n is a value which is set in S901) in a certain subframe are each to be set as a sensor value acquisition target block. As a result, in cases where there is no block that is determined to be a sensor value acquisition target (step S909: Yes), sensor value acquisition in that subframe is not carried out. Then, the acquisition position decision unit 107 waits until the receipt of timer interrupt for the notice of the following sensor value acquisition timing is inputted (step S910). When timer interrupt is received, the acquisition position decision unit 107 (the control flow) advances to step S911.

In cases where determinations for sensor value acquisition target blocks according to step S903 through step S905 have not yet been carried out for one column (step S909: No), the acquisition position decision unit 107 (the control flow) advances to step S911.

In step S911, the acquisition position decision unit 107 increments by one the line number (m) of a block for which a determination is made as to whether the block is set as a sensor value acquisition target block or not. Then, in cases where the line number m exceeds the number of lines (in this embodiment, in the case of m≥11) (step S912: Yes), the acquisition position decision unit 107 returns to step S902, in order to carryout a determination from the blocks in the line 1 again. On the other hand, in cases where the line number m does not exceed the number of lines (step S912: No), the acquisition position decision unit 107 returns to step S903, where it carries out determinations for the blocks in the following line.

Figure 10:
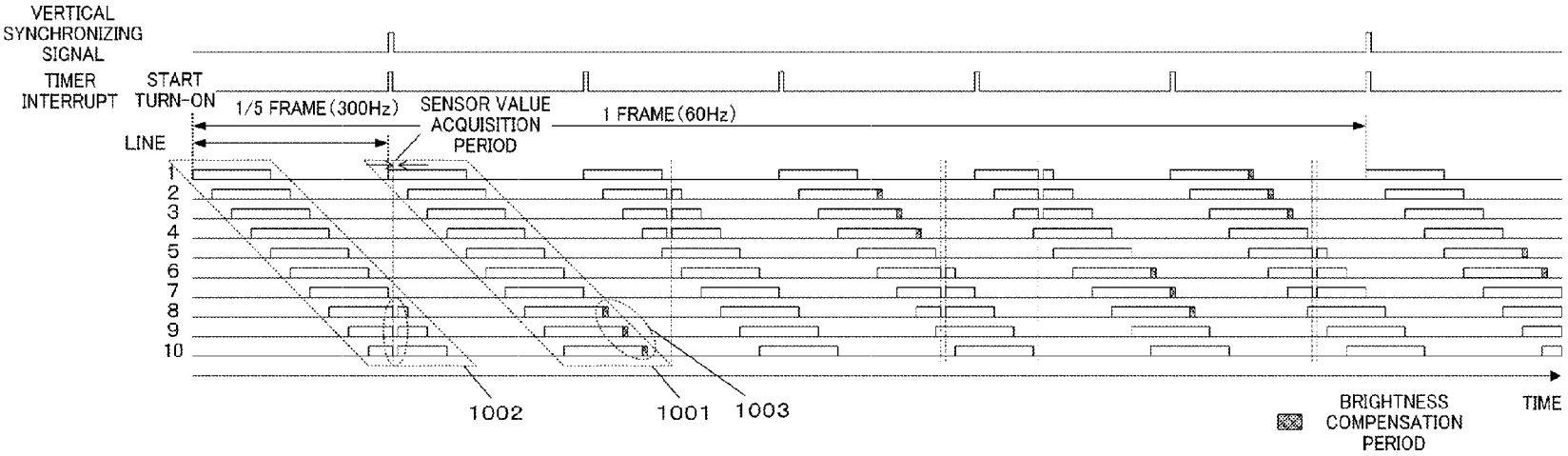
FIG. 10 is a timing chart of PWM control at the time of acquiring sensor values in the first embodiment of the present invention.

FIG. 10 is a timing chart for acquiring sensor values in this embodiment.

For example, in a sensor value acquisition period in the line 1, the lines 8 through 10, in which their turn-on periods of time have started in a subframe 1002 immediately before (i.e., one preceding) a subframe 1001 to which the sensor value acquisition period belongs, are turned off.

In addition, a period of time 1003 for carrying out brightness compensation for a turn-off period of time in each of the lines 8 through 10 is added to the following subframe, i.e., the subframe 1001 in which the sensor value acquisition period in the line 1 is included.

In cases where turn-on control in each line is carried out with a PWM control value exemplified in FIG. 10, when the sensor value acquisition target blocks are decided based on the flow chart of FIG. 9 by means of the acquisition position decision unit 107, it will be understood that the order of sensor value acquisition becomes as follows: line 1, 5, 9, 4, 8 - - - .

FIG. 11 is a view showing the order of blocks for acquisition of sensor values thereof decided according to the flow chart of FIG. 9, in cases where the PWM control exemplified in FIG. 10 is carried out with respect to each line.

As shown in FIG. 11, based on the result of the determination of the acquisition position decision unit 107, the sensor control unit 106 acquires sensor values in the following order, starting from a block L [1] [1] (first column and line 1 in the left side surface). That is, the order is L [5] [1], L [9] [1], L [4] [1], L [8] [1], L [2] [1], L [10] [1], L [3] [1], L [7] [1], L [1] [2] - - - . Subsequently, moving to the second column in the left side surface, the sensor control unit 106 continues to acquire sensor values in the order of L [5] [2], L [9] [2], L [4] [2] - - - .

At this time, acquisition of sensor values is also carried out in the same order for the blocks in the right side surface. That is, the sensor control unit 106 acquires sensor values in the following order, starting from a block R [1] [1] (first column and line 1 in the right side surface). That is, the order is R [5] [1], R [9] [1], R [4] [1], R [8] [1], R [2] [1], R [10] [1], R [3] [1], R [7] [1], R [1] [2], R [5] [2], R [9] [2], R [4] [2] - - - .

Figure 12:
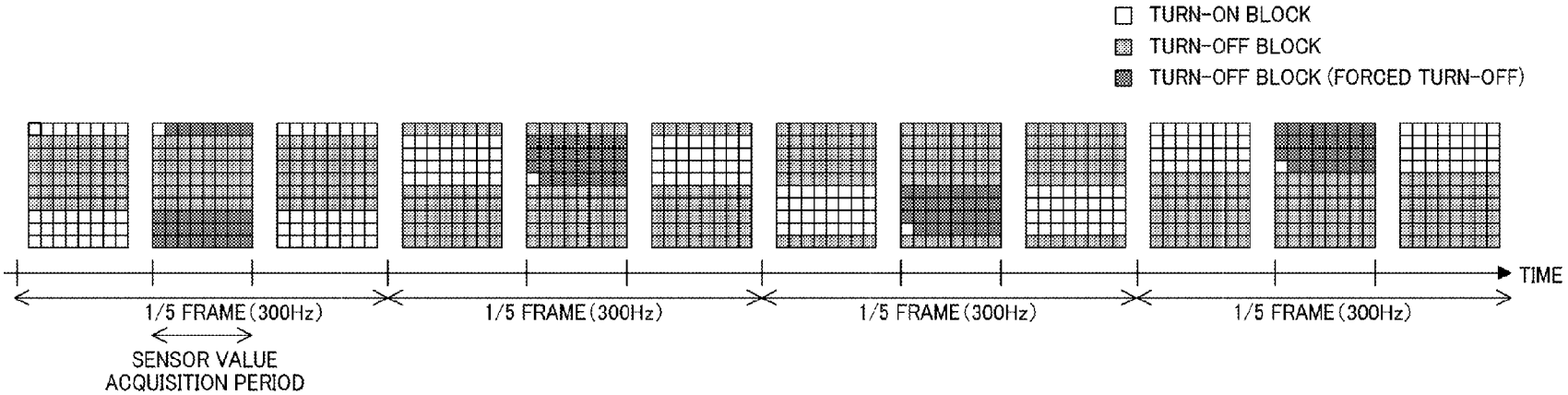
FIG. 12 is a view showing turn-on states of a left side surface of the backlight at the time of acquiring sensor values in the first embodiment of the present invention.
Figure 13:
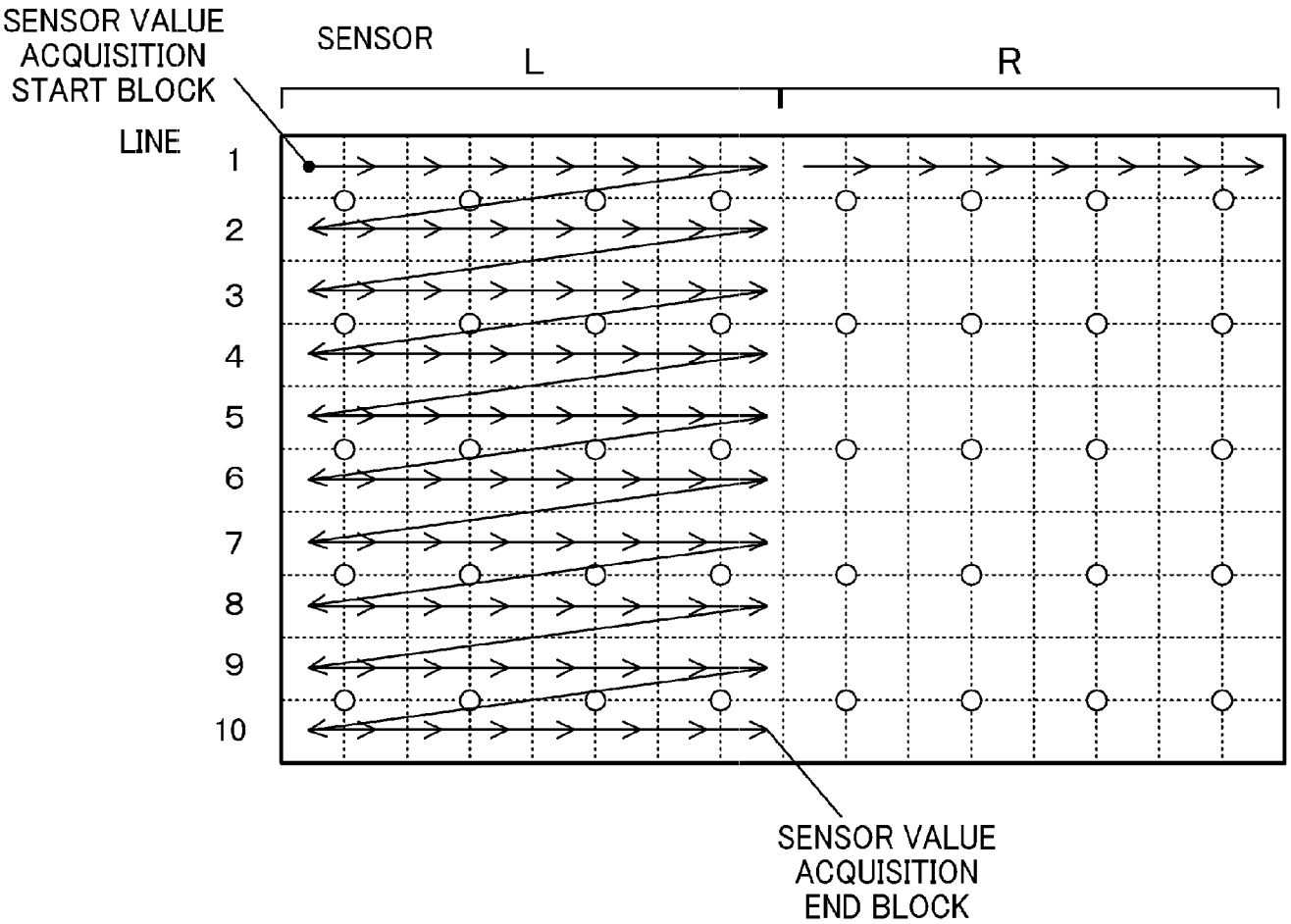
FIG. 13 is a view showing the construction of a backlight and an example of an order of sensor value acquisition in a conventional example.
Figure 14:
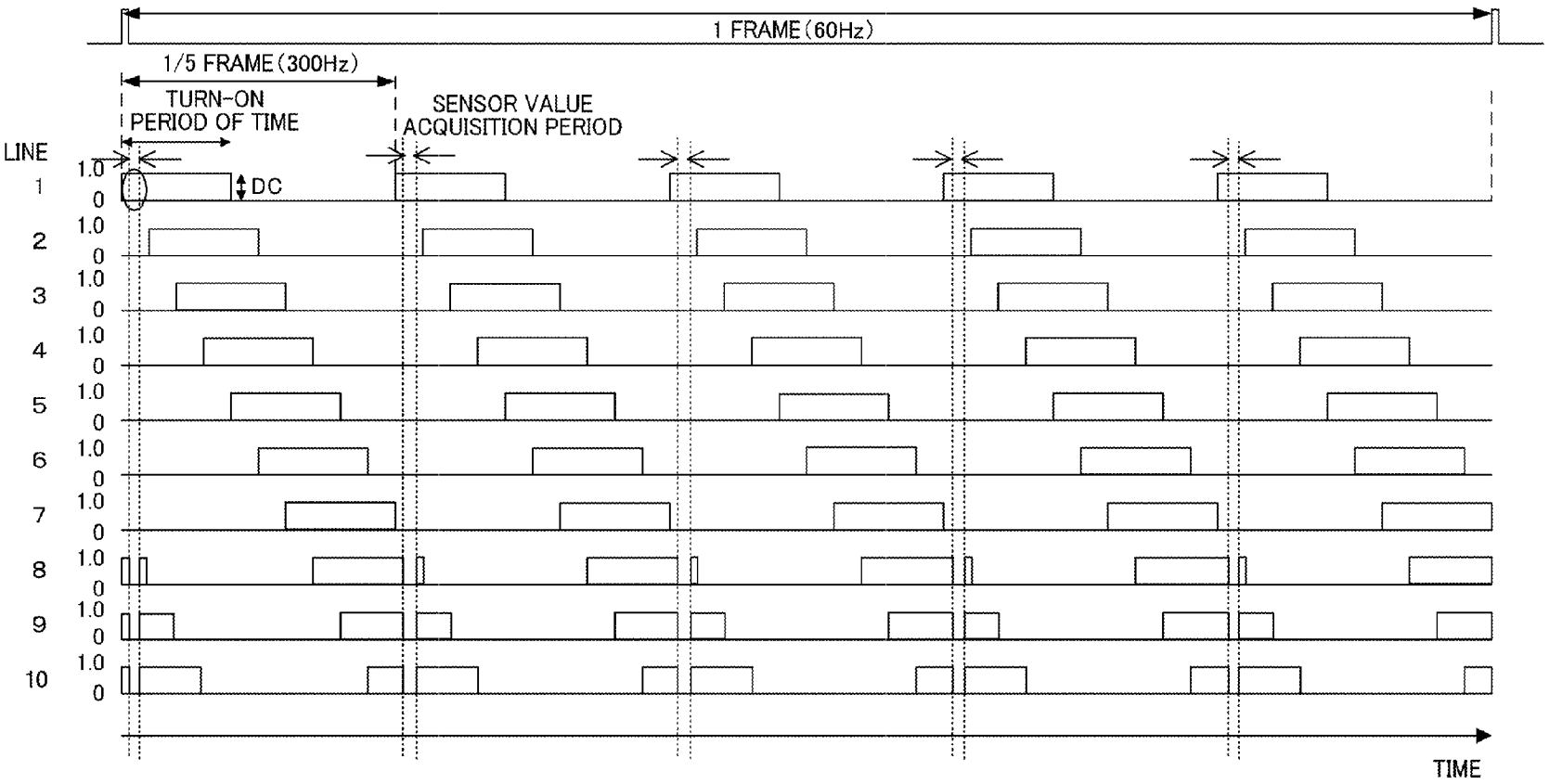
FIG. 14 is a timing chart of PWM control at the time of acquiring sensor values in the conventional example.

FIG. 12 is a view schematically showing a temporal change in the turn-on states of the right side surface of the backlight unit 112 in cases where acquisition of the sensor value of each block is carried out in the order shown in FIG. 11. In FIG. 12, for the sake of simplified illustration, only a sensor value acquisition period and turn-on states immediately before and immediately after each sensor value acquisition period are extracted and described from among each subframe period. For example, in the first subframe period, there are described only a turn-on state at the time of carrying out sensor value acquisition for a block at the first column in the line 1 and turn-on states in which the lines 1, 8 through 10 are turned on immediately therebefore and immediately thereafter. After this, in actuality, a period of time in which the lines 1, 2, 9 and 10 are turned on, another period of time in which the lines 1, 2, 3 and 10 are turned on, and so on continue, but the description thereof is omitted. In the second subframe period, there are described only a turn-on state at the time of carrying out sensor value acquisition for a block at the first column in the line 5 and turn-on states in which the lines 2 through 5 are turned on immediately therebefore and immediately thereafter. In actuality, before this, there is a period of time in which the lines 1 through 4 are turned on, etc., and after this, there is a period of time in which the lines 3 through 6 are turned on, etc.

As shown in FIG. 12, in a sensor value acquisition period, only a sensor value acquisition target block is turned on and all the other blocks are turned off, including also the blocks in those lines which are originally in turn-on periods of time in the sensor value acquisition period.

Figure 15:
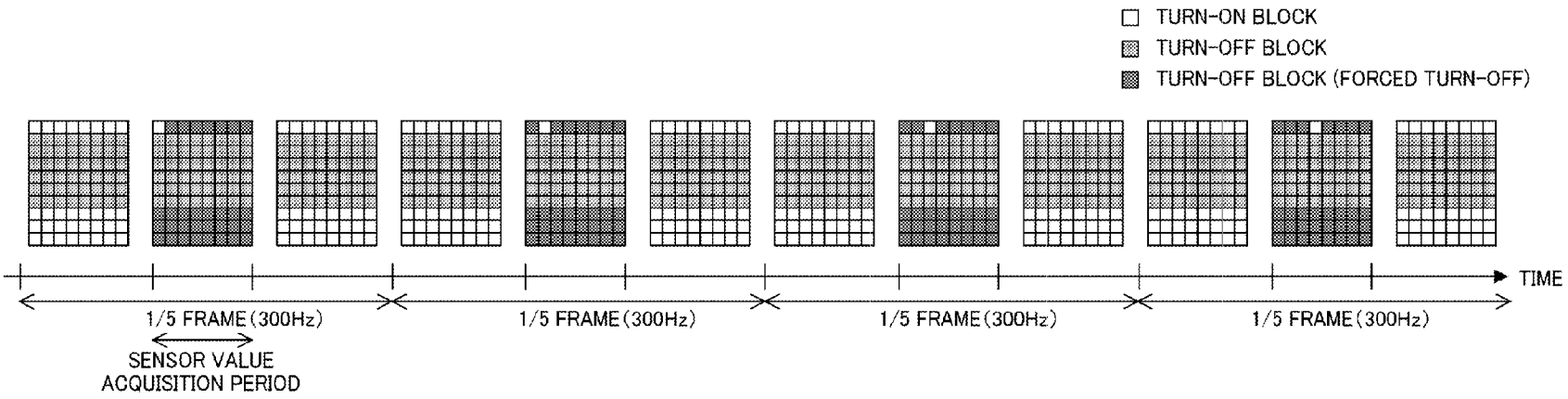
FIG. 15 is a view showing turn-on states of the backlight at the time of acquiring sensor values in the conventional example.

In this embodiment, as shown in FIG. 12, those lines which are forced to turn off accompanying the sensor value acquisition of a block in another line change for each subframe (i.e., subframe by subframe). As a result of this, a flicker becomes difficult to be recognized, as compared with the conventional technology (refer to FIG. 15) in which the same lines are forced to turn off accompanying the sensor value acquisition of blocks in other lines continuously over a plurality of subframe periods.

In an image display apparatus of this embodiment, in a sensor value acquisition period of a block in a certain line, in cases where LEDs of blocks in other lines, which are originally in turn-on periods of time, respectively, are forced to turn off, a rapid variation or change of brightness accompanying the forced turning-off is suppressed, by decreasing the current value before and after the forced turning-off. This serves to reduce a flicker.

Further, sensor value acquisition is carried out in such a manner that blocks in the same line do not continuously become sensor value acquisition targets, as a consequence of which the same line does not become a target which is continuously forced to turn off accompanying the sensor value acquisition of blocks in other lines. Accordingly, it is possible to prevent a certain fixed region of the backlight from blinking in a fixed period of time, accompanying the forced turning-off, so a flicker is reduced.

In FIG. 7 of this embodiment, reference has been made to an example in which in cases where the brightness of those blocks which become targets to be forced to turn off in the periods of time before and after a sensor value acquisition period is made to a lower brightness than usual, the brightness lower than usual is only one kind of brightness, but the target blocks to be forced to turn off may be turned off in a stepwise manner through a plurality of kinds or levels of brightness. In addition, in such a case, the number of steps or levels of brightness may be made different between the case where brightness is made lower in a stepwise manner before a turn-off period of time, and the case where brightness is made higher in a stepwise manner after the turn-off period of time. Moreover, in this embodiment, reference has also been made to an example in which the present invention is applied to the backlight apparatus of the image display apparatus, but the present invention can be applied to a lighting apparatus which has a plurality of light sources with the emission of light thereof being able to be independently controlled, and in which when the brightness of a certain light source is measured, the other light sources are controlled to be turned off.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-089619, filed on Apr. 10, 2012, which is hereby incorporated by reference herein in its entirety.

What is claimed is:

1. A lighting apparatus comprising:

a plurality of light sources of which emissions of light are able to be controlled independently of one another;

a control unit configured to control brightness of each of said light sources; and a measurement unit configured to measure the brightness of each of said light sources;

wherein in cases where the brightness of each of said light sources is measured by said measurement unit, said control unit carries out a first control which causes a measurement target light source to turn on and at the same time light sources other than said measurement target light source to turn off, and a second control which decreases the brightness of each of the light sources in a stepwise manner immediately before a turn-off period of time thereof, and which increases the brightness of each of the light sources in a stepwise manner immediately after the turn-off period of time.

2. The lighting apparatus as set forth in claim 1, wherein said control unit controls the brightness of each light source by carrying out pulse width modulation control on a turn-on period of time and a turn-off period of time of each light source; and said control unit carries out control to increase at least either one of a turn-on period of time and a current value in cycles including and following a cycle provided with the turn-off period of time, so as to compensate for a brightness decrease due to the provision of the turn-off period of time, for those light sources which become targets to be turned off accompanying the measurement of the brightness of a certain light source by said measurement unit.

3. The lighting apparatus as set forth in claim 2, wherein said control unit further carries out control to increase at least either one of the turn-on period of time and the current value for said light sources in cycles including and following a cycle provided with the turn-off period of time, so as to compensate for a brightness decrease due to changing the brightness for said light sources in a stepwise manner before and after the turn-off period of time.

4. The lighting apparatus as set forth in claim 2, wherein said control unit does not set the light sources for which at least either one of the turn-on period of time and the current value has been increased so as to compensate for said brightness decrease, as targets to be turned off accompanying the measurement of brightness by said measurement unit.

5. A backlight apparatus of an image display apparatus which includes the lighting apparatus as set forth in claim 1, wherein said plurality of light sources corresponds to a plurality of light emission blocks which are arranged in a transverse direction and in a vertical direction of a screen of the image display apparatus;

said control unit controls the light emission of each light emission block by making start timings of turn-on periods of time within the same cycle of pulse width modulation control different from one another for each line which is a set of light emission blocks with the same position in the vertical direction; and said control unit changes the line of a light emission block, which is set as a brightness measurement target to be measured by said measurement unit, for each cycle of the pulse width modulation control.

6. A control method for a lighting apparatus which is provided with a plurality of light sources of which emissions of light are able to be controlled independently of one another, said method comprising:

a control step of controlling brightness of each of said light sources; and a measurement step of measuring the brightness of each of said light sources;

wherein said control step includes:

a first control step of causing a measurement target light source to turn on and at the same time light sources other than said measurement target light source to turn off, in cases where the brightness of each of said light sources is measured in said measurement step; and a second control step of decreasing the brightness of each of the light sources in a stepwise manner immediately before a turn-off period of time thereof, and increasing the brightness of each of the light sources in a stepwise manner immediately after the turn-off period of time.

7. The control method for a lighting apparatus as set forth in claim 6, wherein in said control step, the brightness of each light source is controlled by carrying out pulse width modulation control on a turn-on period of time and a turn-off period of time of each light source; and in said control step, a control is carried out to increase at least either one of a turn-on period of time and a current value in cycles including and following a cycle provided with the turn-off period of time, so as to compensate for a brightness decrease due to the provision of the turn-off period of time, for those light sources which become targets to be turned off accompanying the measurement of the brightness of a certain light source in said measurement step.

8. The control method for a lighting apparatus as set forth in claim 7, wherein in said control step, a control is further carried out to increase at least either one of the turn-on period of time and the current value for said light sources in cycles including and following a cycle provided with the turn-off period of time, so as to compensate for a brightness decrease due to changing the brightness for said light sources in a stepwise manner before and after the turn-off period of time.

9. The control method for a lighting apparatus as set forth in claim 7, wherein in said control step, the light sources for which at least either one of the turn-on period of time and the current value has been increased so as to compensate for said brightness decrease are not set as targets to be turned off accompanying the measurement of brightness in said measurement step.

10. A control method for a backlight apparatus in an image display apparatus including a lighting apparatus with a plurality of light sources, wherein said plurality of light sources corresponds to a plurality of light emission blocks which are arranged in a transverse direction and in a vertical direction of a screen of the image display apparatus, said method comprising:

the individual steps in the control method for a lighting apparatus as set forth in claim 6, wherein in said control step, the light emission of each light emission block is controlled by making start timings of turn-on periods of time within the same cycle of pulse width modulation control different from one another for each line which is a set of light emission blocks with the same position in the vertical direction; and in said control step, the line of a light emission block, which is set as a brightness measurement target to be measured in said measurement step, is changed for each cycle of the pulse width modulation control.

* * * * *